United States Patent [19]

Takatsu

[11] 4,453,396

[45] Jun. 12, 1984

[54] HEMMING APPARATUS

[76] Inventor: Suehiro Takatsu, c/o Kabushiki Kaisha Takatsu Seisakusho, 22, 3-chome, Nanabancho, Minato-ku, Nagoya-shi, Aichi-ken, Japan

[21] Appl. No.: 418,260

[22] Filed: Sep. 15, 1982

Related U.S. Application Data

[63] Continuation of Ser. No. 157,092, Jun. 6, 1980, abandoned.

[30] Foreign Application Priority Data

Jul. 13, 1979 [JP] Japan ..... 54-89137

[51] Int. Cl.[3] ..... B21D 5/01; B21D 5/16

[52] U.S. Cl. ..... 72/387; 72/312; 72/386

[58] Field of Search ..... 72/386–388, 72/384, 312–315, 319–321

[56] References Cited

U.S. PATENT DOCUMENTS

| | | | |
|---|---|---|---|
| 944,559 | 12/1909 | Johnston | 72/315 |
| 1,527,375 | 2/1925 | Nystrom | 72/314 |
| 1,572,376 | 2/1926 | Bingham | 72/315 |
| 1,575,487 | 3/1926 | Huber | 72/313 |
| 1,785,537 | 12/1930 | Stevens | 72/314 |
| 1,966,472 | 7/1934 | Way | 72/314 |
| 2,225,988 | 12/1940 | Greif | 72/313 |
| 2,370,128 | 2/1945 | Aneiros | 72/305 |
| 2,726,702 | 12/1955 | Laxo | 72/315 |
| 2,822,545 | 2/1958 | Eickhoff | 72/313 |
| 3,058,512 | 10/1962 | Chebuhar et al. | 72/305 |

FOREIGN PATENT DOCUMENTS

| | | |
|---|---|---|
| 712749 | 7/1965 | Canada . |
| 189030 | 2/1957 | Fed. Rep. of Germany . |
| 16-20710 | 10/1941 | Japan . |
| 53-44466 | 4/1978 | Japan . |
| 475190 | 11/1974 | U.S.S.R. . |

*Primary Examiner*—Daniel C. Crane
*Attorney, Agent, or Firm*—Parkhurst & Oliff

[57] ABSTRACT

A hemming apparatus comprising a body; a bottom form fixed to the body; a top-form ram provided above the bottom form and vertically movable against the bottom form; a bracket set up on the body at the side of the bottom form; a yoke rotatably pivoted to the bracket and pressable by the top-form ram; and a bending blade fixed to a tip end of the yoke and integrally formed therein with a preliminary bending blade surface for preliminarily bending a work and a primary bending blade surface for bending the preliminarily bent work to a finished state. By this structure, the hemming apparatus has novel features of simplifying the apparatus, preventing displacement of the work during bending-formation, and preventing an outer plate from being wrinkled, while the advantage of a conventional hemming apparatus of continuously carrying out preliminary and primary bending operations by lowering movement of a top-form ram is retained.

7 Claims, 7 Drawing Figures

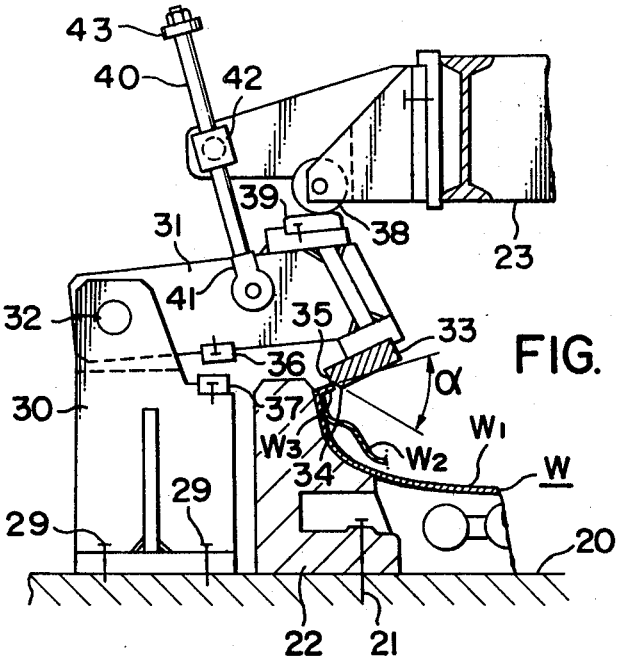
FIG. 6
FIG. 7
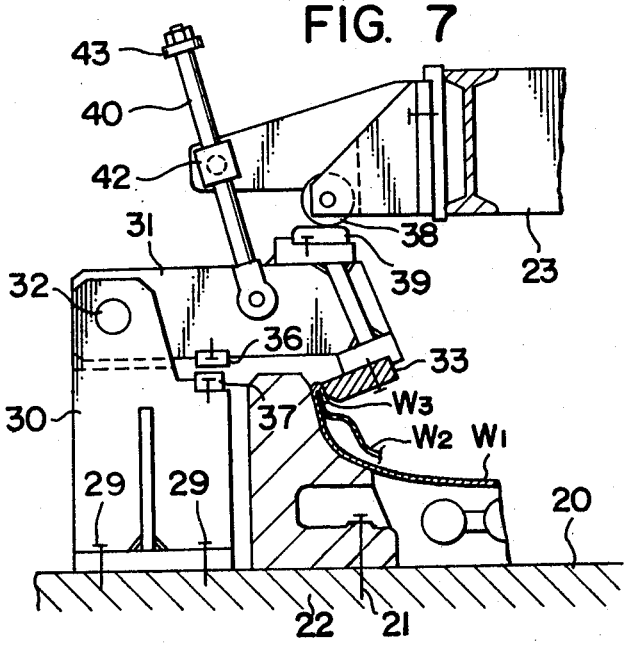

HEMMING APPARATUS

This is a continuation of application Ser. No. 157,092 filed June 6, 1980, now abandoned.

BACKGROUND OF THE INVENTION

1. Field of the Invention:

The present invention relates to a hemming apparatus for a double plate structure consisting of an outer plate and an inner plate and more particularly to a hemming apparatus for bending an edge portion of the outer plate so as to be folded around the opposed edge portion of the inner plate.

2. Description of the Prior Art:

A bonnet, side doors, luggage compartment door, etc., of a motorcar are usually of a double structure consisting of inner and outer plates, in which structure the edge portion of the outer plate is bent and folded around the opposed edge portion of the inner plate.

Taking a bonnet of a motorcar as an example, an operation of bending an outer plate by a conventional hemming apparatus will be described.

First, an outer plate $W_1$ of a work W is placed on a bottom form 1 of a press shown in FIG. 1, and an inner plate $W_2$ is then set on the outer plate $W_1$.

A top form 2 of the press is lowered to allow a preliminary bending cam 3 attached thereto to come into engagement with a preliminary bending arm 4 pivotally connected to the bottom form 1. The preliminary bending arm 4 is then rotated toward the work to allow a preliminary bending blade 5 attached to the arm 4 to press against a peripheral edge $W_3$ of the outer plate $W_1$. Thus, the peripheral edge $W_3$ of the outer plate $W_1$ is bent to such an extent that it is conveniently subject to a primary bending operation which is carried out afterwards.

When the top form 2 is then further lowered, the preliminary bending cam 3 comes out of engagement with the preliminary bending arm 4 as shown in FIG. 3, so that the arm 4 is returned to its original position to thereby render the space above the bent peripheral edge $W_3$ of the outer plate $W_1$ clear.

When the top form 4 is lowered still further, a laterally slidable slider 6 provided on that portion of the top form 2 which is arranged to be above the bent peripheral edge $W_3$ of the outer plate $W_1$ is moved close thereto as shown in FIG. 4, so that a primary bending blade 7 attached to the slider 6 comes into engagement with the primarily-bent peripheral edge $W_3$ of the outer plate $W_1$. Thus, the peripheral edge $W_3$ of the outer plate $W_1$ is subjected to a finishing bending operation so as to be bent around the opposed edge portion of the inner plate $W_2$.

In this case, it is necessary that at the same time as the primary bending blade 7 moves downwardly, it should slide laterally in a direction in which the work is pressed. Accordingly, slider 6 is adapted to move laterally as it moves downwardly, by providing a slide cam 8 thereon which is engageable with a cam 9 having an inclined surface and attached to the bottom form 1.

A conventional hemming apparatus mentioned above permits bending work up to a final stage by conducting preliminary and primary bending operations independently in the mentioned order during one downward movement of the top form 2 for each of the bending operations.

However, the preliminary bending mechanism of this type should be removed from the space above the work W before starting a primary bending operation. Accordingly, this type of hemming apparatus necessarily has a complicated construction. Moreover, since the shapes of the peripheral edges or flanges $W_3$ of the work W are often different on all sides of a bonnet, the work may possibly be displaced on the bottom form 1 during a preliminary or primary bending operation and as a result, the work may not be properly formed. Furthermore, a large downward force is applied to the outer plate $W_1$ at the primary bending, so that such a portion thereof that is designated by a symbol C in FIG. 4 buckles, for example in a shape of creases, wrinkles or the like, which will make the manufactured products inferior.

Therefore there is a need for a hemming apparatus of this kind to be further improved so as to solve the above-mentioned problems.

SUMMARY OF THE INVENTION

An object of the present invention is to provide a novel hemming apparatus wherein the advantage of a conventional hemming apparatus of continuously carrying out preliminary and primary bending operations by lowering movement of a top form is retained, while simplifying the apparatus, preventing displacement of the work at bending-formation, and preventing the occurrence of wrinkles on an outer plate.

To this end, the present invention provides a hemming apparatus comprising a body, a bottom form fixed to said body, a top-form ram mounted above said bottom form and vertically movable against said bottom form, a bracket set up on the body at the side of the bottom form, a yoke rotatably pivoted to the bracket and pressable against the top-form ram, a bending blade fixed to a tip end of the yoke and integrally formed with a preliminary bending blade surface for preliminarily bending a work and a primary bending blade surface for bending the preliminarily bent work to a finished state, a pressure roller rotatably provided on the top-form ram to press the yoke, and a rod connecting the yoke and the top-form ram for lifting up the yoke.

The above and other objects as well as advantageous features of the invention will be made clear from the following description of preferred embodiments taken in conjunction with the accompanying drawings.

BRIEF DESCRIPTION OF THE DRAWINGS

FIGS. 1–4 are sectional views of a principal portion of a conventional hemming apparatus, wherein FIG. 1 shows a work set on a bottom form;

FIG. 2 shows the work subjected to a preliminary bending operation;

FIG. 3 shows a preliminary bending means removed from the space above the preliminarily bent edge portion of the work; and FIG. 4 shows the work subjected to a primary bending operation.

FIG. 6 is a sectional view of a principal portion of the hemming apparatus shown in FIG. 5, which is in an initial stage of a preliminary bending operation; and FIG. 7 is a sectional view of a principal portion of the hemming apparatus shown in FIG. 5, which is at the completion of a primary bending operation.

DESCRIPTION OF THE PREFERRED EMBODIMENT

A hemming apparats embodying the present invention will be described with reference to the accompanying drawings.

Figure 1:
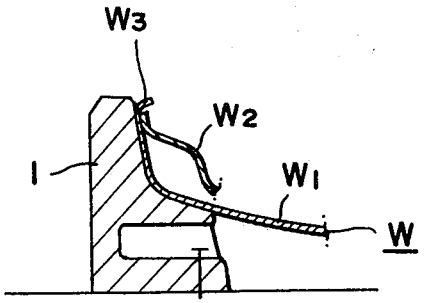
FIG. 1 PRIOR ART
Figure 3:
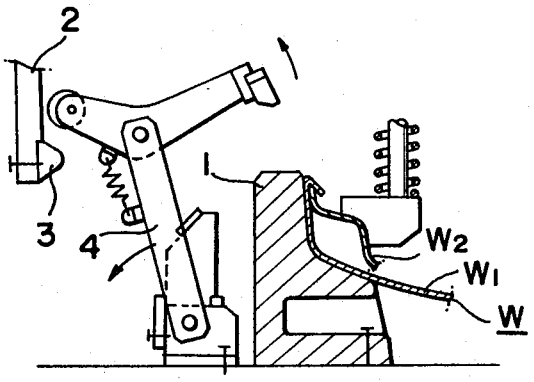
FIG. 3 PRIOR ART
Figure 2:
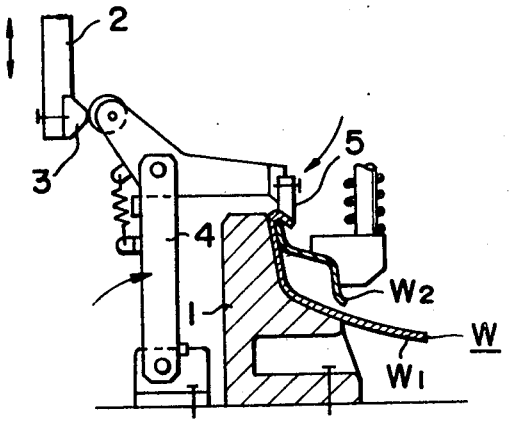
FIG. 2 PRIOR ART
Figure 4:
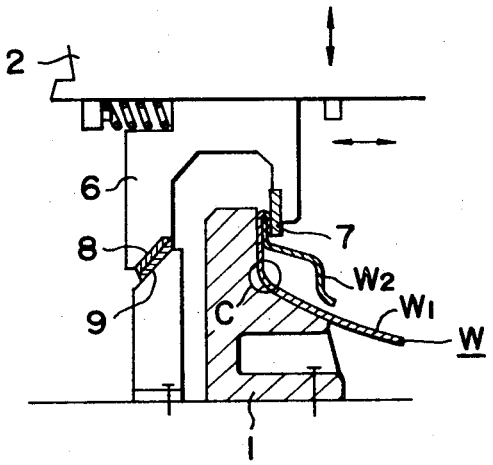
FIG. 4 PRIOR ART
Figure 5:
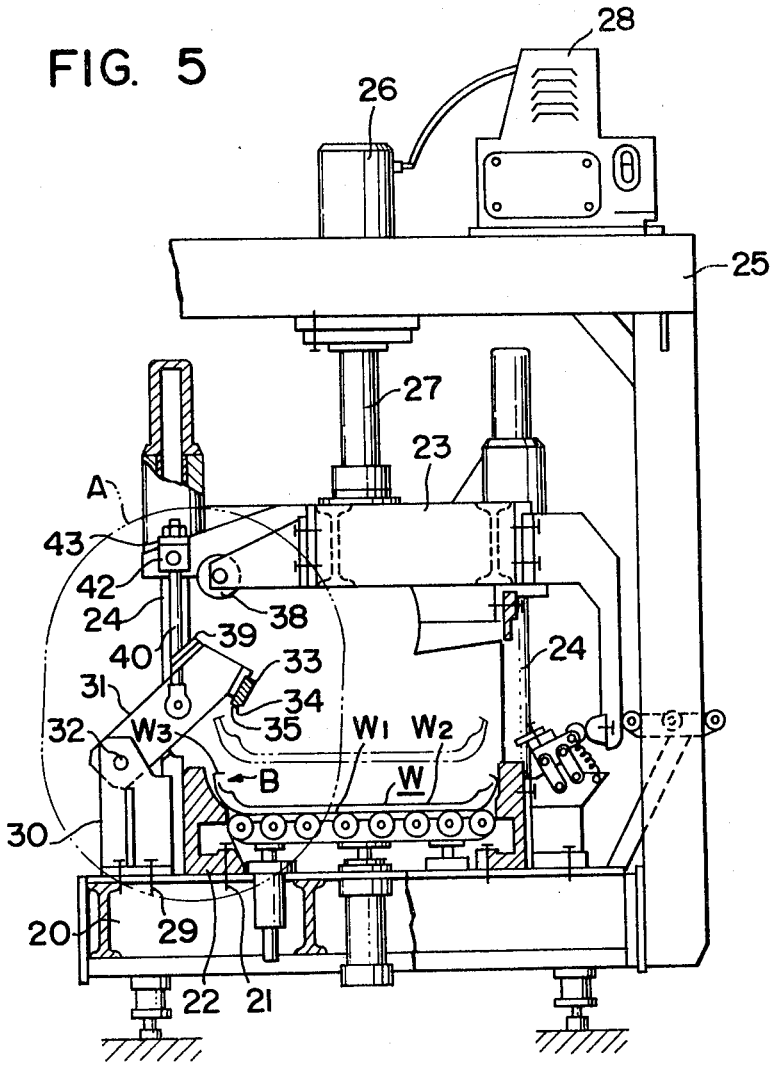
FIG. 5 is a sectional view of a heming apparatus as a whole embodying the present invention.

FIG. 5 is a sectional view of a hemming apparatus according to the present invention.

Reference numeral 20 denotes a body of the hemming apparatus. A bottom form 22 is fixed to the body 20 by a fixing means 21 such as bolt, etc. The shape of the upper surface of the bottom form 22 is so formed as to be adapted to an outer configuration of formed work W and so formed as to set the well-fitting work W on the bottom form 22. Above the bottom form 22, a top-form ram 23 is provided to move up and down freely (move vertically) against the bottom form 22. In more detail, a post 24 extending upward-vertically is set on the body 22, and the top-form ram 23 is guided to move up and down along the post 24. The vertical movement of the top-form ram 23 is usually driven in such a manner that a high-pressure cylinder 26 is attached to a fixed frame 25 provided above the body 20. The lower end of rod 27 of said high-pressure cylinder 26 is attached to the top-form ram 23, and the high-pressure cylinder 26 is actuated by an oil-pressure pump unit 28. In the drawing, a cylinder arrangement is used for the vertical movement of the top-form ram 23, but a means used for this purpose is not limited to a cylinder, e.g., there may be used a screw rod fixed to the top-form ram 23 with a female screw means engaged with the screw rod and positioned on the fixed frame 25, the female screw means being rotated by a motor.

FIGS. 6 and 7 show the construction of the encircled portion with a mark A in FIG. 5 together with the operation thereof. In these figures, a bracket 30 extending upwardly is planted upright on and fixed to the body 20 on the side position of the bottom form 22 by a fixing means 29 such as bolt, etc. The bracket 30 extends upwardly higher than position B where the work to be set on the bottom form 22 is bent (FIG. 5). A yoke 31 is rotatably pivoted to the bracket 30, the yoke extending from the bracket 30 above the position B while the work W is being bent. The pivot point 32 of the yoke 31 is made to be positioned above the position B where the work is bent. The yoke 31 rotating around the pivot point 32 is made to obliquely contact the surface of the bottom form 22 corresponding to the bending portion of the work W, drawing a rotation arc.

At the tip end of the yoke 31, where the yoke 31 can contact the work W, is fixed a bending blade 33 for bending a standing-up peripheral edge $W_3$ of an outer plate $W_1$ of the work W consisting of the outer plate $W_1$ and an inner plate $W_2$ in such a manner that the peripheral edge $W_3$ is bent so as to enfold the inner plate $W_2$. The bending blade 33 consists of a plate piece integrally formed with a preliminary bending blade surface 34 which comes into contact with the standing-up peripheral edge $W_3$ of the outer plate $W_1$ so as to preliminarily bend it to the extent that it is convenient for effecting primary bending, and a primary bending blade surface 35 primarily bending the preliminarily bent standing-up peripheral edge $W_3$ to a finished state. The preliminary bending blade surface 34 and the primary bending blade surface 35 meet at an angle and the preliminary bending blade surface 34 coming into contact with the standing-up peripheral edge $W_3$ of the work W is so arranged as to be at a predetermined angle $\alpha$ of from 20° to 70° at the moment when the preliminary bending blade surface 34 comes into contact with the standing-up peripheral edge $W_3$. The primary bending blade surface 35 contacting the work W is so arranged as to be parallel to the surface of the bent portion of the work W set on the bottom form 22, in a final bending state of the work W.

Stoppers 36, 37 are attachably and detachably provided on and between the bracket 30 and the yoke 31 respectively, in order to appropriately adjust the installing position and angle of the bending blade 33. It is desirable to remove the stoppers 36, 37 after the bending blade is adjusted and attached to the yoke 31.

A pressure roller 38 for applying pressure to the yoke 31 is rotatably provided on the top-form ram 23, at the position where the ram 23 can press the yoke 31 downwardly or obliquely-downwardly at the bending of the work W. The pressure roller 38 is provided for naturally absorbing the sliding movement by the rotating movement of yoke 31 since the contacting surfaces of the yoke 31 and the top-form ram 23 conduct the pressing actuation accompanied by sliding movement. A pressure plate 39 for adjusting the pressure-receiving position of the yoke and preventing abrasion of the portions to be pressed of the yoke 31 is provided on an upper surface of the yoke 31, where the pressure roller 38 presses.

The top-form ram 23 and the yoke 31 are connected to each other by a rod 40 which enables the yoke 31 to be raised upwardly from a position of the work W to be bent by rotating the yoke 31 in correspondence with the vertical movement of the top-form ram 23. The rod 40 is, at its one end 41, rotatably pivoted to the yoke 31, with a bearing block 42 through which the rod 40 can freely slide rotatably provided on the top-form ram 23. However end 41 could just as readily be rotatably pivoted on top-form ram 23 with bearing block 42 being rotatably mounted on yoke 31.

A stopper 43 having an external form larger than the inner diameter of the hole of the bearing block 42 is provided on the other end of the rod 40. Accordingly, when the top-form 23 is raised, the bearing block 42 engages with the stopper 43 so that the yoke 31 may be raised up. In this case, since both the bearing block 42 and the rod 40 are freely rotatably supported, change of the positional relationship therebetween during raising is naturally adsorbed.

The operation of the hemming apparatus having the above construction will be described as follows:

First, the work W consisting of a combination of the outer plate $W_1$ and the inner plate $W_2$ is set on the bottom form 22.

An oil pressure pump unit 28 is then actuated to lower the top-form ram 23 close to the bottom form 22. With the lowering of the top-form ram 23 the yoke 31 simultaneously rotates towards the work W centering around the pivot point 32. The preliminary bending blade surface 34 of the bending blade 33 comes into contact with the standing-up peripheral edge $W_3$ of the outer plate $W_1$ at a predetermined crossing angle $\alpha$ from 20° to 70° against the outer plate $W_1$.

When the top-form ram 23 is further lowred, the top-form ram 23 presses the yoke 31 through the pressure roller 38, whereby the yoke 31 further rotates about pivot point 32 drawing a rotational arc to preliminarily bend the standing-up peripheral edge $W_3$, as shown in FIG. 6. At this preliminary bending stage, the crossing angle $\alpha$ is regulated within the appropriate range, so that the bending can be smoothly carried out. Moreover, since the bending blade 33 intrinsically draws the rotational arc, the outer plate $W_1$ of the work w is prevented from an unreasonably great downward pressing force being applied thereto and the outer plate $W_1$ is neither displaced nor wrinkled.

When the top-form ram 23 is further lowered, the rotation of the yoke 31 further proceeds and the face of the bending blade 33 contacting with the work W is shifted from the preliminary bending blade surface 34 to the primary bending blade surface 35, and finally, the final bending state is accomplished as shown in FIG. 7. In this state, the contacting faces of the primary bending blade surface 35 and the bottom form 22 are parallel to each other, so that the portion to be bent of the work W is completely bent. By the movement along the rotational arc drawn by the bending blade 33, the primary bending blade surface 35 is to press the work W in the direction of an almost right angle against the contacting face of the bottom form 22 and the outer plate $W_1$ is prevented from an unreasonably great perpendicularly downward pressing force being applied thereto, so that the outer plate $W_1$ is neither displaced nor wrinkled. In this shaping operation by bending, both a preliminary bending and a primary bending are simultaneously effected by way of one downward movement of the top-form ram 23.

After the final bending is completed, the top-form ram 23 is raised, and the yoke 31 is lifted up by means of the engagement of the stopper 43 and the bearing block 42, and the space above the work W is cleared so as to take out the bent-formed work W from the bottom form 22. The work W thus removed is sent to the next step. Thereafter, the above-described operations are repeated.

The following various effects can be obtained according to the hemming apparatus of the present invention.

Both a preliminary bending and a primary bending can be simultaneously effected during one downward movement of a top-form ram because the top-form ram is able to move up and down above a bottom form fixed to a body; a yoke is pivoted to a bracket on the side of the bottom form on the body; a bending blade is fixed to the tip end of the yoke and has integrally formed thereon a preliminary bending blade surface for preliminarily bending a work and a primary bending blade surface for bending the preliminarily bent work to a finished state; and a pressure roller is provided on the top-form ram at its position where pressing of the yoke may be carried out.

Furthermore, according to the above-mentioned device, there is no necessity to form a separate preliminary bending blade and a separate primary bending blade as is required in the conventional one and it is not necessary to remove the preliminary bending blade from a space above the work when the bending is shifted from the preliminary bending to the primary bending. Thus simplification of the bending device can be attained.

Moreover, according to this device, the bracket is positioned on the side of the bottom form, the yoke is so formed as to extend from the bracket ranging above a position where the work is bent on the bottom form, and a supporting point of the bracket to which the yoke is installed is disposed to be above the position where the work is bent. Therefore, the bending blade provided on the tip end of the yoke intrinsically draws the rotational locus, a perpendicularly downward pressing force to be applied to the work can be decreased and the outer plate of the work is preserved from wrinkling as well prevented from being displaced on the bottom form.

What is claimed is:

1. A hemming apparatus for bending the peripheral edge of an outer plate around an edge portion of an inner plate, comprising: a body; a bottom form fixed to said body; a top-form ram so mounted above said bottom form as to be vertically movable along an axis against said bottom form, said top form ram having an outer periphery lying in a plane extending perpendicular to said axis; an entirely stationary bracket planted upright on the body at the side of the bottom form; a yoke positioned to extend from the bracket ranging above a position where the outer plate sitting on the bottom form is bent, rotatably pivoted to the bracket around a support point positioned higher than the position where the outer plate is bent and pressable by said top-form ram, said support point being laterally spaced outwardly from the outer periphery of said top form ram; a bending blade fixed to a tip end of the yoke and integrally formed with a preliminary bending blade surface for preliminarily bending the outer plate and a primary bending blade surface for bending the preliminarily bent outer plate to a finished state in which said outer plate has been bent such that the peripheral edge of said outer plate pinches said inner plate against and is substantially parallel to an adjacent portion of said outer plate supported against said bottom form, said primary bending blade surface being directed to the inside of its rotational arc and substantially parallel to the surface of an adjacent portion of the bottom form when in a final bending position; said bottom form being located between said bracket and the primary bending blade surface in its final bending position; said preliminary bending blade surface being at an acute angle to an adjacent portion of the bottom form when in said final bending position; said preliminary bending blade and primary bending blade surfaces meeting each other at an obtuse angle; a pressure roller rotatably mounted on the top-form ram to press the yoke and naturally absorb the sliding movement accompanying pressing actuation conducted between contacting surfaces of the rotating yoke and the vertical moving top-form ram; and a rod connecting the yoke and the top-form ram for lifting up the yoke.

2. The hemming apparatus according to claim 1, wherein said bending blade is so attached to the yoke as to allow the preliminary bending blade to act on a standing-up peripheral edge of the work at an angle of from 20° to 70° at the moment when the bending blade comes in contact with the work.

3. The hemming apparatus according to claim 1 further comprising stoppers attachably and detachably provided on and between the bracket and the yoke respectively, for appropriately adjusting the installing position and angle of the bending blade.

4. The hemming apparatus according to claim 1, wherein the pressure roller rotates to absorb the sliding movement created by the contacting surfaces of the rotating yoke and the vertically moving top-form ram.

5. The hemming apparatus according to claim 1, including a pressure plate provided on a surface of the yoke where the pressure roller presses the yoke, for preventing abrasion of a portion of the yoke being pressed as well as adjusting to a pressure-receiving position of the yoke.

6. The hemming apparatus according to claim 1, wherein the rod is, at one end, rotatably pivoted to one of the top-form ram and yoke, and a bearing block through which the rod freely slides rotatably attached to the other one of the top-form ram and yoke.

7. The hemming apparatus according to claim 6, wherein the rod is, at the other end thereof, provided with a stopper having an external form larger than an inner diameter of a hole through the bearing block, whereby the bearing block engaging with the stopper when the top-form ram moves upwardly lifts the yoke up and chane of positional relationship while the yoke is lifted up can be naturally absorbed since the bearing block and the rod are rotatably supported.

* * * * *